United States Patent [19]

Deaton et al.

[11] Patent Number: 4,643,310

[45] Date of Patent: Feb. 17, 1987

[54] ONE HUNDRED EIGHTY DEGREE STACK AND NEST BAKERY TRAY WITH BAILS

[75] Inventors: Thomas P. Deaton, Mason; Eric D. Stein, Cincinnati, both of Ohio

[73] Assignee: Buckhorn Material Handling Group, Inc., Milford, Ohio

[21] Appl. No.: 652,489

[22] Filed: Sep. 20, 1984

[51] Int. Cl.[4] ..... B65D 21/04; B65D 21/06

[52] U.S. Cl. ..... 206/506; 206/507

[58] Field of Search ..... 206/506, 507

[56] References Cited

U.S. PATENT DOCUMENTS

| | | | |
|---|---|---|---|
| 2,765,099 | 10/1956 | Lively | 206/506 |
| 4,106,623 | 8/1978 | Carroll | 206/506 |
| 4,109,791 | 8/1978 | Clipson | 206/506 |
| 4,335,068 | 6/1982 | Hemery | 206/507 |
| 4,379,508 | 4/1983 | Miller | 206/507 |
| 4,423,813 | 1/1984 | Kreeger | 206/506 |
| 4,440,302 | 4/1984 | Ehrmann | 206/506 |
| 4,466,541 | 8/1984 | Tabler | 206/506 |

FOREIGN PATENT DOCUMENTS

| | | | |
|---|---|---|---|
| 1128878 | 8/1982 | Canada | 206/506 |
| 2090227 | 7/1982 | United Kingdom | 206/506 |

*Primary Examiner*—George E. Lowrance

*Attorney, Agent, or Firm*—Beall Law Offices

[57] ABSTRACT

A bakery basket is molded of synthetic resin, plastic, and is provided with three levels: a fully nested level, and two different upper stacked levels, one being formed by rigid stacking surfaces engaging when the trays are rotated 180 degrees from their nesting position and the other stacking level being provided by flipping bails for either rotated position of the trays. A particular bail hinge construction is disclosed and bail position retainers in the middle of the bail to hold one of its positions, for example, the nesting position.

8 Claims, 20 Drawing Figures

ONE HUNDRED EIGHTY DEGREE STACK AND NEST BAKERY TRAY WITH BAILS

BACKGROUND OF THE INVENTION

The present invention relates to bakery trays, which are primarily molded plastic trays with four sides that may contain bakery products during shipping of the products, with a plurality of trays being stacked upon one another during transit. Usually, structure is provided to nest the trays, when empty, so that they take up less room in the truck or the like during the return trip to the bakery.

In the past, nesting and stacking has been obtained by providing 180° rotation of one tray relative to another tray between such two positions, or by providing bails that rotate between a position permitting nesting and a position providing stacking of an upper tray on the bails.

SUMMARY

It is an object of the present invention to provide a new and improved bakery tray of molded synthetic resin.

Molded resin bails with integral hinge portions are assembled when cold in a hot tray by the press operator as the tray is removed from the mold, to assist assembly and thereby provide for assembly by the single mold operator during otherwise unproductive time, thereby avoiding the employment of additional people for assembly purposes.

Nesting with at least two levels of stacking is obtained by providing 180° stack and nest structure in cooperation with flipping bails; the bails, being separately molded, have different indicia, preferably color, to indicate the relative 180° rotation alignment of adjacent baskets.

Problems relating to detents to resist movement of a bail from one position to another have been solved by the use of a single snap fit detent in the vicinity of the axial mid-portion of the bail and spaced radially from the bail axis. Problems that have been solved are that axially spaced apart detents are difficult to disengage by only one hand, and accumulated tolerances causing more or less detent action.

In the past, flipping bails molded of synthetic resin have considerably contributed to the overall width of the basket, but the present invention provides bails that move from a 180° position inwardly to a 45° position, and thereby they contribute less to the width of the basket, that is for a given basket volume, the present invention reduces the overall width of the basket, or looked at in another way, for a given overall basket width, the interior volume of the basket is increased.

In the past, bails, particularly plastic bails, have extended to the outside of the baskets, when in the nesting position. In such position, they have been used as handles, which greatly shortens their life, and they have been exposed to damage when striking hard objects during handling. In the present invention, the bails, in all positions, are completely inwardly of rigid side wall structure, and thereby they are protected from such abuse, so that their useful life may be extended and their construction need not be as heavy to obtain the same results.

When used for stacking, the bails rest on ramp surfaces at about 45°, so that the weight of upper loaded trays is transferred to the fixed hinge support and does not materially bend the bails.

These and other objects, advantages and structure will become more apparent from the following detailed description of a preferred embodiment of the present invention, as set forth with respect to the drawing, wherein.

DETAILED DESCRIPTION OF THE PREFERRED EMBODIMENT

While many embodiments are contemplated within the broad concepts, a preferred embodiment with structural details is shown for the purposes of a detailed illustration as well as the advantages of narrow structural features, in the accompanying drawing, wherein like numerals refer to like parts.

The tray, excluding the bails, is molded homogeneously in one piece of synthetic resin, preferably by injection molding. The bails are correspondingly molded in one piece, respectively.

Figure 1:
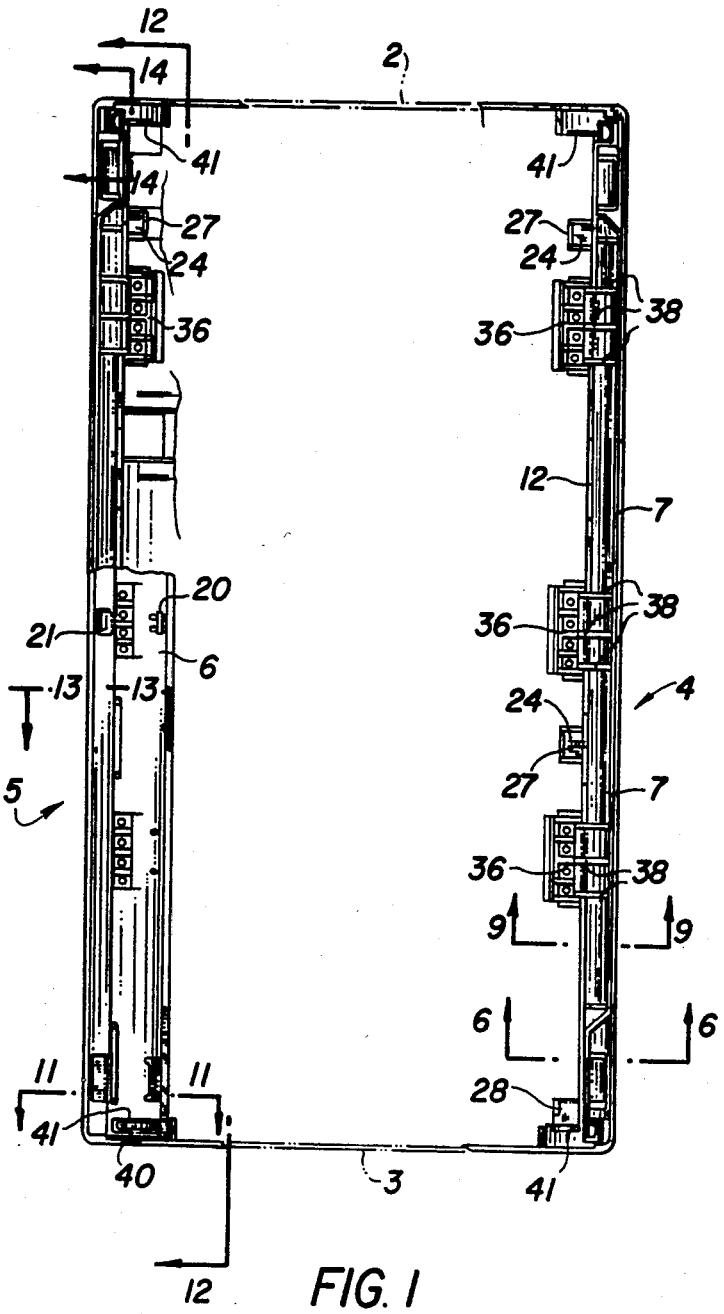
FIG. 1 is a top plan view of a bakery basket according to the present invention.
Figure 8:
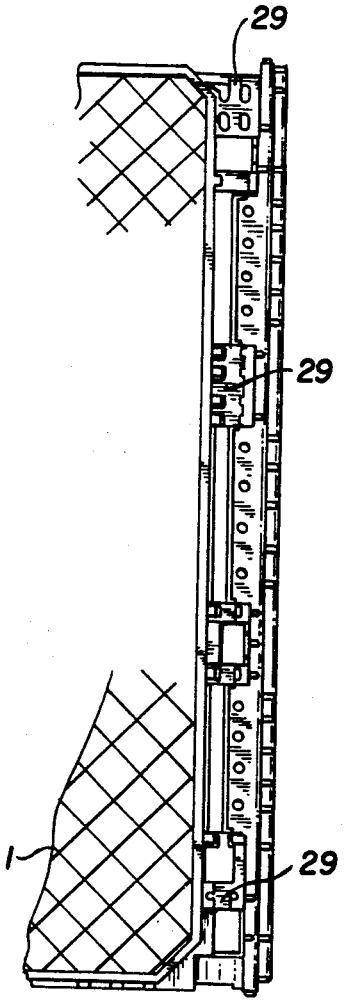
FIG. 8 is a bottom view of the right side of the tray shown in FIG. 1, with the left side being a mirror image.
Figure 2:
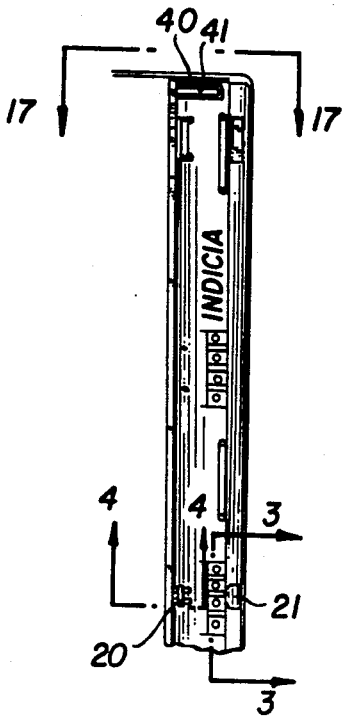
FIG. 2 is a top plan view of a portion of FIG. 1 for the bail in its stacking position.
Figure 11:
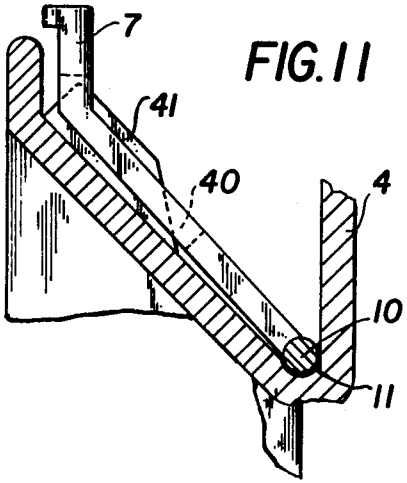
FIG. 11 is a partial cross-sectional view taken along line 11—11 in FIG. 1, with the bail in its stacking position.

The tray body, that is the tray without the bails, is formed of a bottom and four sides. Preferably, the bottom is provided with an open grid, as schematically shown in FIG. 8 for bottom 1. Opposite side walls 2, 3 may be of any shape, but preferably have some vertical extent to provide beam strength for the tray. Most preferably, these side walls 2, 3 are lower than the remaining two side walls and are identical. The remaining two side walls 4, 5 are mirror images with respect to a vertical centerline (not shown) for FIG. 1, are not symmetrical with respect to a corresponding horizontal centerline. All the side walls are sloped upwardly and outwardly and are configured so as to provide for full nesting in one orientation and stacking in an orientation rotated 180° about a central axis perpendicular to the bottom wall 1, for two like containers. This 180° stack/nest relationship is known per se in molded plastic bakery trays without bails, and therefore the structure that accomplishes the same will not be described in detail.

Figure 9:
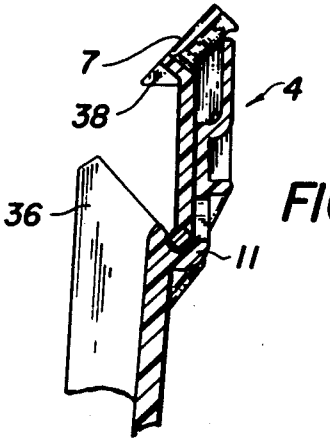
FIG. 9 is a partial cross-sectional view taken along line 9—9 of FIG. 1, with the bail in its nesting position.
Figure 10:
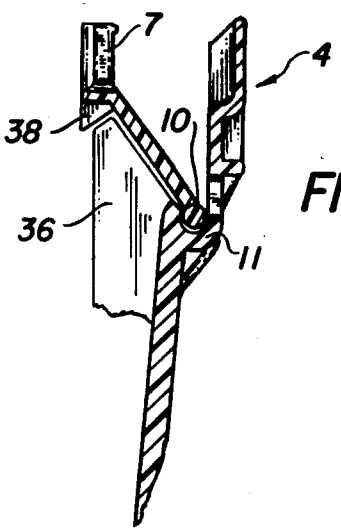
FIG. 10 is a partial cross-sectional view, similar to FIG. 9, but with the bail in its highest stack position.
Figure 12:
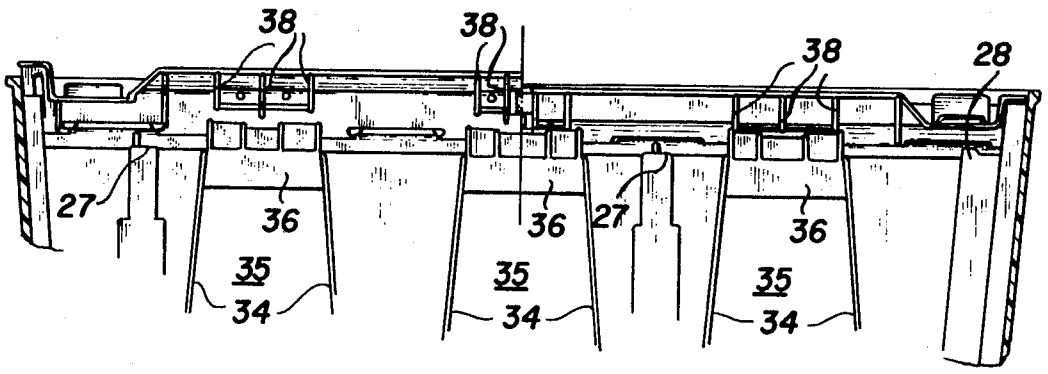
FIG. 12 is a partial cross-sectional view taken along line 12—12 in FIG. 1, from the inside of the tray, showing one-half of the bail in its nesting position and the other half of the bail in its stacking position.

Bails 6, 7 are respectively pivotally connected to the sides 5, 4 for rotation about respective horizontal axes that are parallel to each other and parallel to sides 4, 5, so that each bail may pivot from a vertical nesting orientation shown in FIG. 9 to a stacking orientation or position shown in FIG. 10 that is approximately 45° inwardly from the nesting position. The hinge structure for the bail is similar to that shown in allowed patent application Ser. No. 371,999, filed Apr. 26, 1982, now U.S. Pat. No. 4,466,541, whose disclosure is incorporated herein. Therefore, only the structural differences in the hinge will be set forth.

Figure 5:
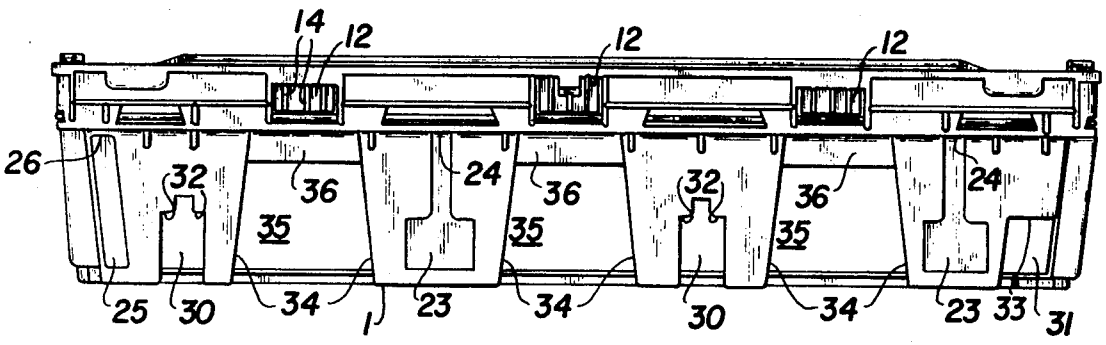
FIG. 5 is a side elevation view taken from the right side of FIG. 1, with the opposite side being a mirror image.
Figure 16:
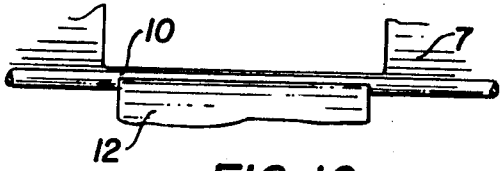
FIG. 16 is a partial top view of the structure shown in FIG. 13.
Figure 14:
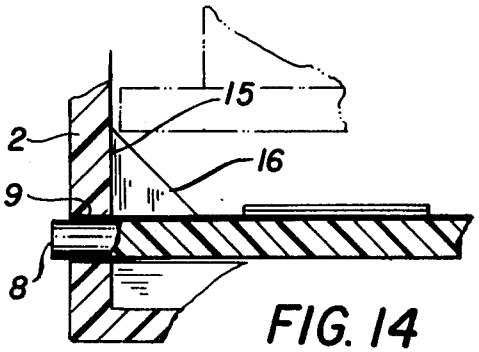
FIG. 14 is a partial cross-sectional view taken along line 14—14 in FIG. 1.
Figure 15:
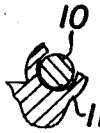
FIG. 15 is a cross-sectional detail of the bail hinge structure.
Figure 13:
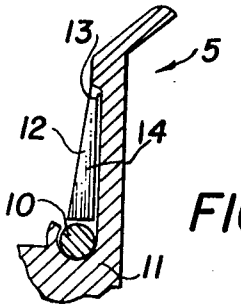
FIG. 13 is a partial cross-sectional view taken along line 13—13 in FIG. 1, showing the bail pivot pin, with the remainder of the bail being removed.

With particular reference to FIGS. 9, 10, 13, 14, 15, 16, the bail hinge structure will be described. Each bail is provided with a plurality of shaft portions, preferably cylindrical, which include outwardly extending cantilevered end portions 8 received in correspondingly sized holes 9 in side walls 2, 3, and intermediate shaft portions 10. The shaft portions 8, 10 are axially aligned for each bail and are integrally molded in one piece with their bail. Shaft portions 10 rest on upwardly facing arcuate bearing portions 11, of various shapes, which are integral with the side walls 4, 5. Most preferably, there are seven such intermediate shaft portions 10 for each bail, with two being held as shown in FIG. 15 and three being held in FIGS. 13 and 16. As shown in FIG. 15, two of the intermediate shaft portions 10 merely rest upon arcuate bearing portions, which are preferably slightly of greater extent than 180°, but which also may be of less extent; the most important parts of such bearing portions are that they support the shaft for loads vertically downward and for loads extending inwardly at 45° from the vertical. As shown in FIGS. 5, 13 and 16, three of the intermediate shaft portions are held within their bearing portions 11 by overlapping catches 12. Each catch 12 is of generally rectangular shape having three free edges and an upper edge integrally connected at 13 to the side wall 4 with a living hinge, so that it may pivot counterclockwise from the normal position of FIG. 13 to permit entry of the intermediate shaft portion 10 into the bearing portion 11, and through its resiliency rotate backward in the clockwise direction with a snap action to trap the intermediate shaft portion 10 during assembly. A plurality (three shown) of vertical ribs 14 are provided on the outside of the catch 12.

In the above-mentioned patent application, it was necessary to bow the bail in order to first axially insert the cantilevered end shaft portions in the holes within the side walls, and thereafter radially force the remainder of the bail shaft portions into their bearings. In contrast, the present invention includes the method of assembly wherein the tray body is removed hot from the mold for assembly with cold bails. Due to the difference in temperature, the cold bails will be approximately the axial length that is equal to the distance between the opposed inside surfaces 15 of the side walls 2, 3 (FIG. 14) so that mere radial insertion of the bails will cam the side walls 2 outwardly and flex the bails when the end of the cantilevered shaft portion enter the holes 9 with a snap action. As the tray body cools, it will shrink so that the cantilevered shaft portions 8 will extend through the holes 9, but until they do the ramp 16 will hold the bails in place. Also with a hot tray body, the living hinges 13 will be quite resilient to permit easy entry of the intermediate shaft portion 10 into the position shown in FIG. 13 by flexing the catch 12. Therefore, assembly of the bails with the present invention is far more economical and less time consuming than with respect to the bails of the above-mentioned application; the injection mold operator does the assembly during normal periods of inactivity without the assistance of anyone else, whereas before considerably more time was required and two people were required for such assembly.

Each of the bails is held in its nesting position by means of a latch or detent structure, which is specifically shown in FIGS. 1, 3, 4, 19 and 20. A first detent portion is provided axially midway along each bail 6, 7 at a position radially spaced from its hinge axis, and includes a mold relief opening 17, opposed parallel side walls 18, and a web wall having at its middle a bar 20. The other detent portion includes an inwardly opening recess 21 having wedge shaped side walls 22. When the bail assumes the nesting position as shown in FIG. 9, the bar 20 snaps past the wedge-shaped side walls 22 and into the recess 21, by resilient deformation of the materials. In moving the bail from the position of FIG. 9 to the position of FIG. 10, the center portion of the bail is pushed in such direction to resiliently pull the bar 20 out of the recess 21. Since this detent structure is in the axially center portion of both the bail and tray side wall, there are substantially no accumulated tolerances that can result in a considerable difference in detent effectiveness between trays. The bail hinge structure has some free play in the axial direction, and the roundness of the bar 20 together with the shape of the side walls 22 will center the detent structure despite some molding inaccuracies so that the detent force will remain uniform from one tray to another. The use of only one detent at the center facilitates releasing of the bail with correspondingly only one force applied at the center of the bail. All of these desirable functions are particularly useful with respect to manual operation, but are even more useful with respect to automated operation for a modern bakery. The detent is more reliable and easier to operate than prior bail detents.

Figure 19:
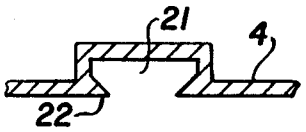
FIG. 19 is a cross-sectional view taken along line 19—19 of FIG. 3.
Figure 20:
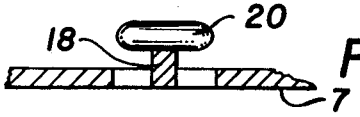
FIG. 20 is partial cross-sectional view taken along line 20—20 in FIG. 4.
Figure 4:
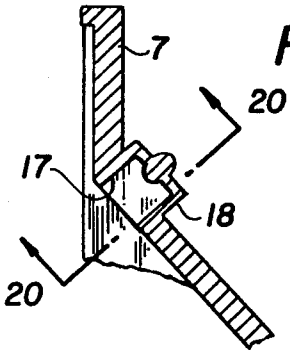
FIG. 4 is a partial cross-sectional view taken along line 4—4 in FIG. 2.
Figure 3:
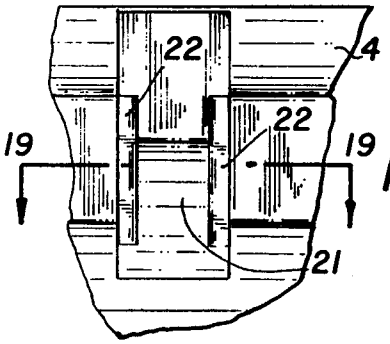
FIG. 3 is a perspective view of a side wall detent portion taken from line 3—3, and FIG. 2.

With the bail in the position shown in FIG. 10, it is normal to grasp the tray by placing one hand at the midportion of each of the side walls 4, 5, and from this position, a quick movement of the hands towards each other will flex the side walls 4, 5 and cause the bails 6, 7 to move to their positions shown in FIG. 9 and engage their detent structure shown in FIGS. 19, 20 without actually touching the bails. This is a result of the approximately 45° angular position for the bail in the high stack position of FIG. 10, because it can be seen that if the bail were horizontal in FIG. 10, this function could not be obtained. This function is desirable for ease in nesting the containers both manually and automatically.

Figure 6:
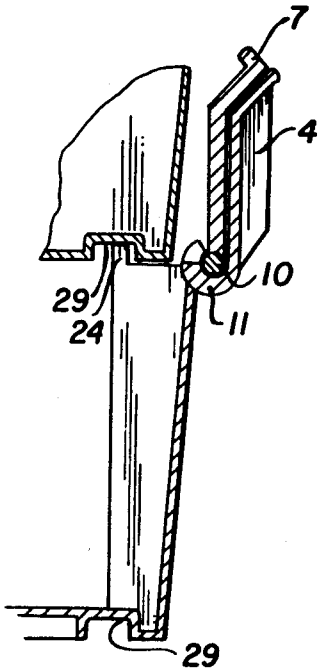
FIG. 6 is a partial cross-sectional view taken along line 6—6 in FIG. 1, with an additional tray stacked thereon.
Figure 18:
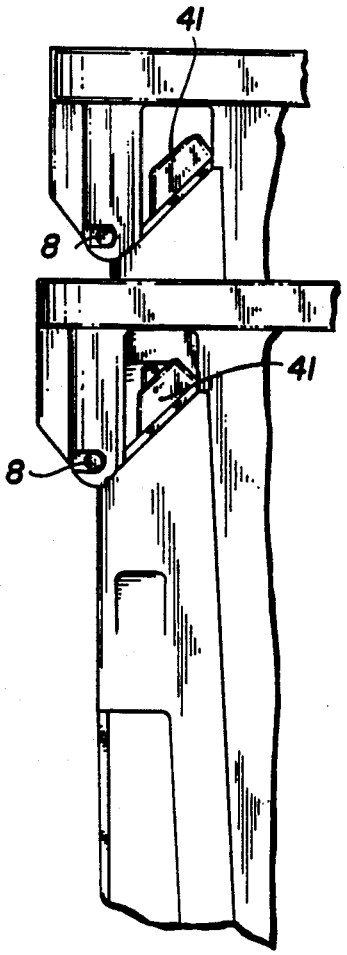
FIG. 18 is a partial side elevational view of the tray of FIG. 17 nested within a like lower tray with its bail in the nesting position.
Figure 17:
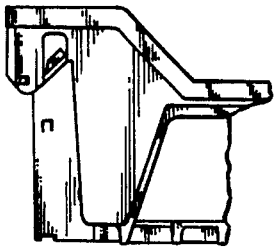
FIG. 17 is a partial side elevational view taken from line 17—17 in FIG. 2 with the bail in its stacking position.

For the bails in the nesting position of FIG. 9, two like tray bodies may fully nest as shown in FIG. 18 or by 180° rotation therefrom they may stack at an intermediate position shown in FIG. 6. Preferably, the bails are provided with indicia to indicate visually stacking alignment or nesting alignment. Most preferably, this is accomplished by moldling the two bails of different colors, so that if the colors are not aligned vertically for two adjacent tray bodies, the trays will nest, and if the colors are aligned vertically for two adjacent trays, the trays will stack at the intermediate position. The two side walls 4, 5, which are preferably the shorter side walls, are provided with structure that accomplishes the full nesting in one orientation and the intermediate stacking in the 180° orientation, whereas the other sidewalls 2, 3 are substantially identical and slope upwardly and outwardly so that they will not interfere in either the nesting or stacking. Molded recessed portions 23 extend inwardly from the side walls 4, 5 shown in FIG. 5 to provide a shoulder 24 more clearly shown in FIG. 1. A similar recess 25 forms a shoulder 26. The shoulders 24, 26 are all at the same height and are provided with upstanding lugs 27, 28 at their inner portions parallel with the adjacent hinge axis. Vertically below each of the shoulders 24, 26, the tray bottom is provided with a notch 29, more clearly shown in FIGS. 6 and 8 that open downwardly to receive therein the lugs 27, 28 in the intermediate stack position.

For nesting, the tray bodies are rotated 180° from their intermediate stack position and nested with their bails in the nesting position shown in FIG. 9. As seen in FIG. 5, three through openings 30, 31 are provided in each end wall 4, 5 to provide downwardly facing edges 32, 33 that will rest upon the shoulders 24, 26 behind the lugs 27, 28, respectively when the trays are in the fully nested position. Each side wall is provided with inwardly extending sloping flanges 34 that nest within each other and surround openings 35 that will accommodate the ledge structure 36 of a lower tray during nesting, which ledge structure extends between the upward portion of the flanges 34. In general, the structure of the sidewalls 4, 5 slope upwardly and outwardly to also facilicate nesting.

Figure 7:
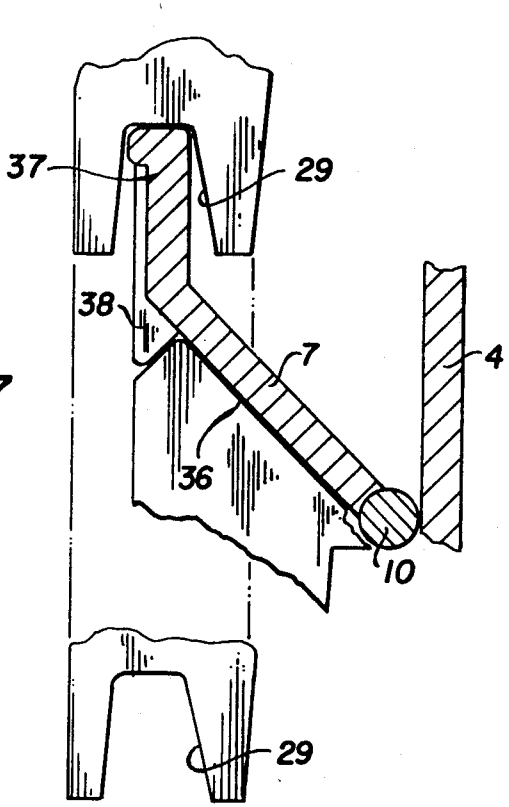
FIG. 7 is a partial cross-sectional view, somewhat schematic, of two trays stacked in their highest position, with the lower tray bails being in the position of FIG. 10.

Bails are shown in their highest stack position in FIGS. 1 (at the left), 12(at the left), 10, 11, and 7. In this position, the ledge structure 36 together with the bearing portions 11 support the bails, which in turn support the upper stacked trays. In the stacked position, the bail generally extends 45° inwardly from the pivot axis of shaft portions 10 as shown in FIG. 7, to an upper bail portion 37 that extends generally vertically upward into the notch 29 or other notch structure in the bottom of the upper tray body. It can be seen from FIG. 7, that the ledge structure 36 is provided with a 45° angle support surface engaging the 45° portion of the bail, so that the weight of the upper stacked boxes will pass vertically through the portion 37 of the bail and be directed downwardly at 45° into the solid bearing portion 11, so that the bearing portion 11 and ledge structure together carry the weight and generally no bending stresses are applied to the bail. Generally adjacent each such ledge structure, each bail is provided with a projection 38 that preferably is spaced from the ledge structure so that it does not function to carry any of the weight of upwardly stacked boxes; the function of this projection 38 is to be seen in FIG. 9, wherein it is seen that the projection 38, with the bail in the nesting position, will function to direct bakery goods into the tray past the ledge structure 36 and thereby act as a guide to prevent bakery products from being caught by the ledge structure 36.

At all times, the bails are protected, which is in contrast to prior art plastic bails for bakery trays. As seen in FIGS. 9 and 10, particularly, the sidewalls 4 extend upwardly to generally the height of the bails along the entire length of the sidewalls, with the bails inside of the sidewalls in all positions. Therefore, the bails cannot be grasped by hand to be used an handles. This is important, because the bails are designed to take forces directed downwardly in the position of FIG. 10, and they are not designed to take upwardly directed forces if they were used as handles. Further, this is important because in handling, the trays are banged against the side walls of other trays, building corners, carts, and truck sides, for example. The relatively rigid sidewall structure may absorb such punishment far more easily than the bails, and with the present invention the side walls protect the bails from such punishment.

By confining the bails to only 45° of movement, they are protected by the sidewalls and ledge structure, downwardly directed stacking forces do not bend the bails, but are rather transmitted along the extent of the bails first downwardly and then at 45° into the solidly supported hinges, the bails do not interfere with loading bakery products into the trays, the bails are not easily damaged, the bails are not used as handles, and the width of the trays is reduced or correspondingly the interior volume of the trays is increased.

To further secure the bails and prevent their bending when in their stacking position, rectangular apertures 40 are provided at each axial end of each bail to receive therein correspondingly shaped upwardly projecting sidewall lugs 41. This structure is particularly shown in FIGS. 1, 2, 11 and 18.

The high stacked position may be accomplished with the trays in their illustrated high stacked position and with the top tray rotated 180° therefrom, that is, the orientation of the trays is not critical in the high stacked position to the extent that it is in both the nesting position and the intermediate stacked position.

While a preferred embodiment has been shown for the specific details of the present invention and for purposes of illustration, other embodiments, modifications and variations are contemplated according to the broader aspects of the present invention, all as determined by the spirit and scope of the following claims.

We claim:

1. In a nestable and stackable bakery tray comprising:

a unitary, one piece tray body of molded synthetic resin material having a bottom wall and two pairs of opposed side walls integrally joined together and integrally extending upwardly from the periphery of said bottom wall;

said side walls being shaped and extending upwardly and outwardly from said bottom wall to permit said container body to be nested within a like container body and the latter to be nested therein when disposed in vertical aligned relationship therewith;

a pair of bails, each being a unitary, one piece, construction of molded synthetic resin;

hinge means unitary in one piece only with each of said bails and one pair of said opposed side walls for pivotally connecting said bails to said one pair of side walls, respectively, for movement about respective parallel horizontal axes that are parallel to said bottom and the longitudinal extent of said one pair of side walls to provide for pivotal movement of said bails relative to said container body between a stacking position wherein each bail extends generally inwardly from its associated pivot axis into the adjacent interior of the body toward the opposed side wall of said one pair of side walls to provide respective upwardly facing support stack surfaces, and a nesting position wherein each bail is disposed outwardly of the adjacent interior of the body to permit said nesting of two like container bodies;

bail support surfaces on said one pair of opposed side walls spaced from the adjacent corresponding pivot axes and engaging the respective bails in their stacking position at contact points spaced radially from said respective pivot axis to resist further inward turning movements of said bails;

said bail structures, when in said stacking position, having their support stack surfaces simultaneously engaging the bottom of a like container stacked thereon in vertical aligned relationship above said container body;

said side walls extending rigidly upward along the entire length of said bails to a height substantially equal to the height of the bails in said stacking and nesting positions and to the outside of the associated bails, to protect the bails from damage during handling and to generally prevent usage of the bails as handles for protection of the bails;

said bails, when in said nesting position, extending vertically upward from their associated hinge axes;

wherein the improvement comprises:

said hinge means including unitary shaft portions on said bails, and side wall bearing portions being concentric with and rotatably engaging said shaft portions;

said bails having a major portion that extends generally inwardly in the stacking position at a 45 degree angle from the nesting position;

said bail support surfaces extending in a corresponding substantially 45 degree angle to provide a ramp upon which said associated bail slidingly rests so that downward forces on said bail in said stacking position caused by the weight of loaded upward stacked like trays will be transferred along the extent of said bail directly to said side wall bearing portions; and each of said bails having an uppermost portion extending upwardly vertically from the inward end of its major portion and the inward end of said support stack surfaces to provide an upwardly facing free edge to be received with the correspondingly shaped bottom of a like upper stacked container.

2. The tray according to claim 1, wherein the inward facing surface of said uppermost portion of each bail has a plurality of downwardly and inwardly sloping cam-shaped flanges that will direct bakery products inwardly and downwardly past the support stack surfaces when the bails are in their nesting position.

3. The tray according to claim 1, wherein said side walls and bails are sufficiently resilient and constructed so that mere inward horizonal bending of the adjacents side wall midportions will correspondingly bend the bails when in their stacking position to cause them to automatically snap to their vertical nesting position.

4. The tray according to claim 3, wherein detent means are provided in the midportion of each of said bails and associated side walls that will engage solely by said snap action without applying any external forces to said bails to securely hold said bails in their nesting position.

5. In a nestable and stackable bakery tray comprising:

a unitary, one piece tray body of molded synthetic resin material having a bottom wall and two pairs of opposed side walls integrally joined together and integrally extending upwardly from the periphery of said bottom wall;

said side walls being shaped and extending upwardly and outwardly from said bottom wall to permit said container body to be nested within a like container body and the latter to be nested therein when disposed in vertical aligned relationship therewith;

a pair of bails, each being a unitary, one piece, construction of molded synthetic resin;

hinge means for pivotally connecting said bails to said one pair of side walls, respectively, for movement about respective parallel horizontal axes that are parallel to said bottom and the longitudinal extent of said one pair of side walls to provide for pivotal movement of said bails relative to said container body between a stacking position wherein each bail extends generally inwardly from its associated pivot axis into the adjacent interior of the body toward the opposed side wall of said one pair of side walls to provide respective upwardly facing support stack surfaces, and a nesting position wherein each bail is disposed outwardly of the adjacent interior of the body to permit said nesting of two like container bodies;

bail support surfaces on said one pair of opposed side walls spaced from the adjacent corresponding pivot axes and engaging the respective bails in their stacking position at contact points spaced radially from said respective pivot axis to resist further inward turning movements of said bails;

said bail structure, when in said stacking position, having their support stack surfaces simultaneously engaging the bottom of a like container stacked thereon in vertical aligned relationship above said container body;

said bails, when in said nesting position, having a major portion extending vertically upward from their associated hinge axes; and wherein the improvement comprises:

said bails including integral arcuate bearing surfaces concentric with the axis of rotation of said hinge means;

said side walls having integral arcuate bearing portions concentric with and rotatably engaging said bail bearing surfaces;

said bails major portion extending generally inwardly in the stacking position at a 45 degree angle from the nesting position; and said bail support surfaces extending in a corresponding substantially 45 degree angle for substantially the full transverse extent of said major portion to provide a ramp upon which said associated bail slidingly rests so that downward forces on said bail in said stacking position caused by the weight of loaded upward stacked like trays will be transferred along the extent of said bail directly to said side wall bearing portions.

6. The tray according to claim 5, wherein each of said bails has an uppermost portion extending upwardly vertically from the inward end of its major portion and the inward end of said support stack surfaces to provide an upwardly facing free edge to be received within the corresponding shaped bottom of a like upper stacked container.

7. The tray according to claim 5, wherein the inward facing surface of said uppermost portion of each bail has a plurality of downwardly and inwardly sloping cam-shaped flanges that will direct bakery products inwardly and downwardly past the support stack surfaces when the bails are in their nesting position.

8. The tray according to claim 5, wherein said side walls and bails are sufficiently resilient and constructed so that mere inward horizontal bending of the adjacents side wall midportions will correspondingly bend the bails when in their stacking position to cause them to automatically snap to their vertical nesting position.

* * * * *